United States Patent [19]

Kobayashi et al.

[11] Patent Number: 4,876,141

[45] Date of Patent: Oct. 24, 1989

[54] DOUBLE LAYER PAVEMENT MARKING SHEET MATERIAL

[75] Inventors: Sadao Kobayashi, Chiba; Yuji Ishihara, Tochigi; Katsuyuki Sato, Tochigi; Kouichi Ijichi, Tochigi, all of Japan

[73] Assignee: Seibulite International Kabushiki Kaisha, Tokyo, Japan

[21] Appl. No.: 216,827

[22] Filed: Jul. 8, 1988

[30] Foreign Application Priority Data

Jul. 17, 1987 [JP] Japan ..... 62-178558

[51] Int. Cl.[4] ..... B32B 7/02; B32B 5/16

[52] U.S. Cl. ..... 428/217; 404/14; 428/325; 428/343; 428/354

[58] Field of Search ..... 428/325, 149, 212, 217, 428/343, 354; 404/14

[56] References Cited

U.S. PATENT DOCUMENTS 4,248,932 2/1981 Tung et al. ..... 428/325

4,751,140 6/1988 Ishihara ..... 404/14

*Primary Examiner*—William J. Van Balen

*Attorney, Agent, or Firm*—Koda and Androlia

[57] ABSTRACT

A double layer pavement marking sheet material comprises a base sheet made of rubber, synthetic resin or the like in which a multiplicity of glass microspheres are embedded. The base sheet comprises an upper layer in which the glass microspheres are embedded in such a manner that a multiplicity thereof are partially exposed from the surface of the base sheet and a lower layer having hardness within a range of 30°–75° and restoration rate of 50% or less. This double layer pavement marking sheet material has such an excellent conformability to the pavement surface that the sheet material is not separated once it has been adhered to the pavement surface.

3 Claims, 1 Drawing Sheet

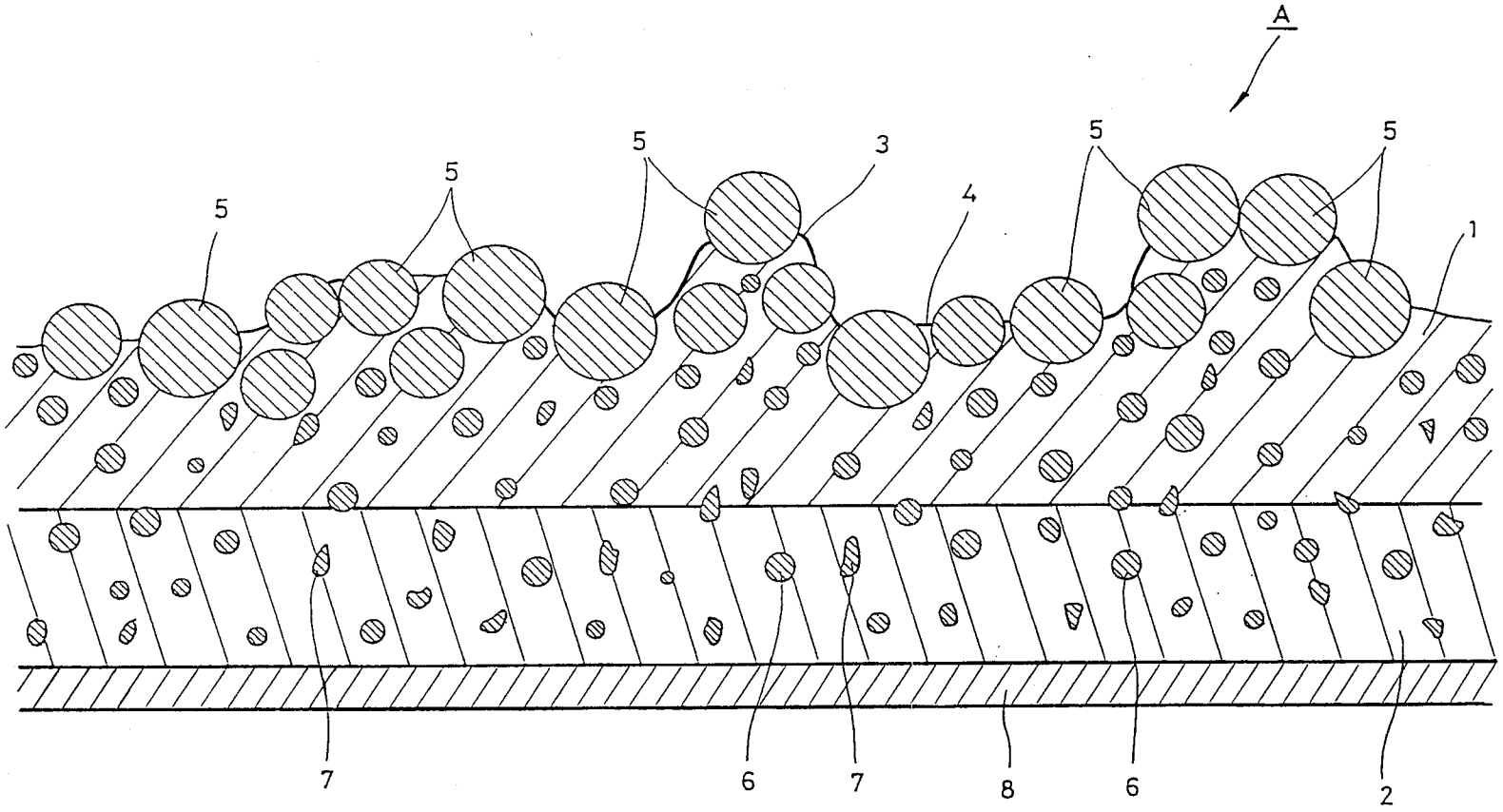
A
1
2
3
4
5
5
5
5
5
5
6
6
7
7
8

DOUBLE LAYER PAVEMENT MARKING SHEET MATERIAL

BACKGROUND OF THE INVENTION

This invention relates to a reflex reflecting pavement marking sheet material and, more particularly, to a double layer pavement marking sheet material having excellent conformability to an irregular pavement surface.

Various sheet materials have heretofore been known as ones adhered to roadway for pavement marking purpose.

One type of such sheet materials is of a double layer structure as disclosed in U.S. Pat. Nos. 4,117,192, 4,248,932 and 4,282,281 in which a microsphere support layer holding a multiplicity of glass microspheres is bonded or coated on a base layer adhered to pavement surface. There is also known a type of such sheet material in which, as disclosed in U.S. Pat. No. 3,935,365, the base layer of such double layer structure is reinforced with cloth or the like reinforcing material.

The surface of pavement generally has irregular protuberances and depressions and a pavement marking sheet material is required to be a relatively soft one for conforming to such irregular pavement surface. In a case where the pavement marking sheet material is made of a single layer soft material, the surface of the sheet material tends to get soiled due to contact with tires of passing vehicle, dust tends to be deposited on the surface of the sheet material and, besides, glass microspheres disposed on the surface of the sheet material tend to be buried into the sheet material due to weight of the passing vehicle with resulting decrease in the reflecting effect. In the above described prior art double layer pavement marking sheet material, a glass microshere support layer made of a relatively hard resin such as hard PVC is provided for holding glass microspheres and preventing dust deposited on the surface of the sheet material. In this structure, the support layer holding the glass microspheres is so thin that the glass microspheres tend to come off in a relatively short period of time. Besides, since hard resin is coated on the surface of the sheet material, it takes time before glass microspheres embedded under the surface of the sheet material are exposed above the surface of the sheet material by the wear of the support layer so that reflection tends to be prevented for a long period of time before the glass microspheres are exposed.

In the prior art double layer pavement marking sheet material, the base layer which is made of material conformable to the irregular pavement surface is not sufficient in conformability to the pavement surface and is not free from the defect that the sheet material in some cases is separated from the pavement surface immediately upon release of pressure imposed upon the sheet material in application thereof on the pavement surface. For compensating for the irregularity of the pavement surface and thereby improving state of bonding of the pavement marking sheet material to the pavement surface, a primer is generally applied over a portion of the pavement surface on which the sheet material is to be bonded before the bonding of the sheet material is carried out. The application of primer however is still not sufficient for preventing such separation of the sheet material immediately after bonding thereof to the pavement surface. If the sheet material is separated from the pavement surface, the bonding ability of the sheet material is lost by reason by deposition of dust on the bonding surface of the sheet material or wetting of the bonding surface due to rain so that the sheet material will not be bonded to the pavement surface again with a result that there arises the likelihood that the sheet material collides with a tire of the passing vehicle and thereby is torn off.

SUMMARY OF THE INVENTION

It is, therefore, an object of the invention to eliminate the above described disadvantages of the prior art pavement marking sheet material and provide a double layer pavement marking sheet material having a remarkably improved conformability to the irregular pavement surface and being capable of completely preventing separation of the sheet material from the pavement surface.

The pavement marking sheet material achieving the above described object of the invention is characterized in that it comprises a base sheet made of rubber, synthetic resin or the like in which a multiplicity of glass microspheres are embedded, said base sheet comprises an upper layer in which said glass microspheres are embedded in such a manner that a multiplicity thereof are partially exposed from the surface of the base sheet and a lower layer having hardness within a range of 30°-75° and restoration rate of 50% or less.

As a result of laborious study and repeated experiments, the inventors of the present invention have confirmed that the double layer pavement marking sheet material of the above described construction has such an excellent conformability to the pavement surface that the sheet material is not separated once it has been adhered to the pavement surface.

BRIEF DESCRIPTION OF DRAWING

The sheet material of the present invention will now be described more specifically in conjunction with the accompanying drawing which is an enlarged sectional view schematically showing an embodiment of the double layer pavement marking sheet material according to the invention.

From the standpoint of obtaining a high initial brightness in reflection in an initial period of use of the sheet material and a sufficient timewise continuity in the brightness in reflection, the upper layer which functions as a glass microsphere holding layer in the double layer pavement marking sheet material of the present invention should preferably be one which is formed on the surface thereof with a continuous pattern of a multiplicity of protuberances and depressions and in which glass microspheres are embedded in these protuberances and depressions in such a manner that a depth of embedding of these glass microspheres in the upper layer is randomly different one from another in the respective protuberances and depressions and a majority of the glass microspheres in these protuberances and depressions are partially exposed from the surface of the upper layer. The accompanying drawing illustrates a sheet material having such structure as the upper layer of the sheet material.

A continuous pattern of a multiplicity of protuberances 3 and depressions 4 of random shapes and dimensions is formed on the surface of an upper layer 1 of base sheet A. A multiplicity of glass microspheres 5 are embedded in the surface portion of these protuberances 3 and depressions 4. These glass microspheres 5 are embedded in the upper layer 1 in such a manner that a depth of embedding of the glass microspheres 5 in the upper layer 1 from the surface of each protuberance 3 and depression 4 is randomly different one from another. A majority of the glass microspheres 5 in these protuberances 3 and depressions 4 are partially exposed from the surface of the upper layer 1 and the height of the exposed portion of these partially exposed glass microspheres 5 is randomly different one from another.

The upper layer 1 requires to be made of a material which is hard to be soiled, is capable of holding the glass microspheres 5 and has durability to various mechanical forces. The upper layer therefore comprises, as its main ingredient, unvulcanized synthetic rubber such, for example, as acrilonitrile-butadiene rubber (NBR), isobutylene-isoprene rubber (IIR) and chloroprene rubber (CR) or a synthetic resin such, for example, as chlorosulphonyl-polyethylene, polyvinyl chloride and chlorinated polyethylene or other material which is known in the field of the pavement marking sheet material. The upper layer 1 may comprise, if necessary, additives including a filler such as calcium carbonate powder, a pigment for providing color to the upper layer 1, small glass microspheres (designated by reference numerals 6 in the figure) and wear resisting particles (designated by reference numeral 7). The mixture of these ingredients is formed into a sheet with a thickness of 2 mm or less by passing it through pressure rolls or by other conventional methods. If the small glass microspheres 6 are mixed in the upper layer, small glass microspheres having a diameter not exceeding about 500 μm may be employed. Those of about 100 μm in average diameter may be conveniently used. The glass microspheres 5 are embedded in the surface portion of the protuberances 3 and depressions 4 of the upper layer 1 with the depth of embedding being randomly different one from another. As the glass microspheres 5, those having a diameter not exceeding about 1,000 μm may be used and preferably are of an average diameter of 50 μm–500 μm. As to refractive index, microspheres having refractive index of 1.3 or more, and preferably 1.5–2.3, may be used. A protective film of a suitable composition may be provided over the surface of the upper layer 1 in which the glass microspheres 5 are embedded.

By virtue of the above described structure of the upper layer 1, a high initial brightness in reflection can be obtained. Further, since the glass microspheres 5 are embedded in the surface portion of these protuberances 3 and depressions 4 in such a manner that a depth of embedding is randomly different one from another, the glass microspheres 5 come off one after another in the order of the depth of embedding when they come into contact with the tire of the passing vehicle and they never come off all at once as in the conventional pavement marking sheet material. Accordingly, the pavement marking sheet material can timewise maintain a high brightness in reflection.

Alternatively, the upper layer 1 may be constructed in such a manner that glass microspheres are embedded in uniform depth in a flat surface portion. Essential requirements for the upper layer 1 are sufficient resistivity to soil, ability to hold glass microspheres and mechanical durability.

A lower layer 2 is required to be made of a material which is softer and less restorable than the upper layer 1 and has such conformability to the irregular pavement surface as to remain bonded to the pavement surface without being separated therefrom after releasing of pressure imposed upon the sheet material in application thereof to the pavement surface. For these reasons, the lower layer 2 is made of a material having JIS K6301 hardness of 30°–75° and restoration rate of 50% or less. Results of tests show that a preferable range of hardness for obtaining a very excellent conformability to the pavement surface is 45°–60° but the separation of the sheet material from the pavement surface can be prevented at the hardness range of 30°–75° depending upon conditions of application of the pavement marking sheet material and type of the bonding material used. If the hardness exceeds 75°, sufficient conformability cannot be obtained even if the restoration rate is 50% or less whereas if the hardness is less than 30°, the material is too soft to maintain the required mechanical strength with resulting tear of the lower layer 2 due to external force applied to the sheet material. Even if the hardness is within the range of 30°–75°, if the restoration rate exceeds 50%, the lower layer 2 tends to restore to a state before application of pressure when pressure applied thereto has been released, and therefore sometimes causes separation from the pavement surface. In this case, therefore, the object of the invention cannot be achieved. It is therefore an important feature of the invention that desired conformability to the pavement surface and resistivity to separation after bonding of the sheet material to the pavement surface can be obtained by unique combination of the specific hardness and restoration rate in the lower layer 2.

The above described hardness and restoration rate can be obtained by, for example, adding a relatively large amount of plastic material in the ingredients of the lower layer 2. The amount of addition of such plastic material required in the entire ingredients of the lower layer 2 is 2 parts by weight or more. Suitable plastic materials for this purpose include elastomer, plasticizers (D.O.P., chlorinated paraffin, epoxi etc.) and liquid rubber. Like the upper layer 1, the lower layer 2 comprises, as its main ingredient, unvulcanized synthetic rubber such, for example, as acrilonitrilebutadiene rubber (NBR), isobutylene-isoprene rubber (IIR) and chloroprene rubber (CR) or a synthetic resin such, for example, as chloro-sulphonyl-polyethylene, and polyvinyl chloride or other material known in the field of the pavement marking sheet material. Like the upper layer 1, the lower layer 2 may comprise, if necesary, additives including a filler such as calcium carbonate powder, a pigment for providing color to the lower layer 2, small glass microspheres (designated by reference numeral 6 in the figure) and wear resisting particles (designated by reference numeral 7). The mixture of these ingredients is formed into a sheet with a thickness of 2 mm or less by passing it through pressure rolls or by other conventional methods. An adhesive layer 8 of a suitable thickness of 50 μm or more, preferably 100 μm–200 μm, is provided under the lower surface of the lower layer 2. The adhesive layer 8 can be formed by coating adhesive on a release paper in a desired thickness and superposing it on the lower surface of the lower layer 2.

For making the sheet material of the present invention, the unvulcanized synthetic rubber or synthetic resin which is an ingredient of the upper layer 1 and the lower layer 2 of the base sheet A is added with desired amounts of the filler, pigment, glass microspheres and other materials if required. A desired amount of plastic material is further added to the material for forming the lower layer 2. The respective mixtures are blended and are formed into sheets of a thickness of 2 mm or less through heated pressure rolls and that sheets constitute the upper layer 1 and the lower layer 2. If necessary, an adhesive coated on a release paper in a thickness of 50 μm or more is superposed on the lower surface of the lower layer 2.

After preparing the upper layer 1 and the lower layer 2 in the foregoing manner, the upper layer 1 and the lower layer 2 are adhered to each other by either coating adhesive on the upper surface of the lower layer 2 or softening the upper surface portion of the lower layer 2 by heating and thereafter superposing the upper layer 1 on the lower layer 2. Alternatively, a previously formed upper layer 1 may be superposed upon a lower layer 2 which has just been extruded from an extrusion sheet forming device and there upon the two layers 1 and 2 may be bonded together by applying pressure by pressure rolls.

After bonding the upper layer 1 and the lower layer 2 together in this manner, solvent of a known type is coated on the surface of the upper layer 1 for facilitating embedding of the glass microspheres 5 into the upper layer 1 and the glass microspheres 5 are uniformly dispersed on an undried surface of the solvent and then the base sheet A is dried. As alternative means for facilitating embedding of the glass microspheres 5, a coating material which is of a composition identical or similar to that of the upper layer 1 may be coated on the surface of the upper layer 1. Then, the base sheet A on which the glass microspheres are dispersed is passed through an embossing device so that an embossed pattern of desired shape and dimensions is formed and simultaneously the glass microspheres 5 are embedded in the surface portion of each protuberance 3 and depression 4 in the upper layer 1 thus formed by embossing. If necessary, the surface of the embossed base sheet A is treated with a releasing agent. The base sheet A thereafter is dried and wound into a roll to provide a finished product.

In the above described manufacturing method, the upper layer 1 and the lower layer 2 are made as separate sheets and these two sheets are then superposed one upon the other and bonded to each other. The method of manufacturing the double layer pavement marking sheet material however is not limited to this method. For example, the upper layer 1 and the lower layer 2 may be formed as a single base sheet from the beginning by employing the same ingredients as the lower layer 2 and the upper layer 1 may be formed by irradiating electron beam on the upper half portion of the single base sheet and thereby hardening the upper half portion whereas the lower half portion of the base sheet which is not irradiated with electron beam may constitute the lower layer 2.

EXAMPLES

The following ingredients were used for producing the upper layer 1 of the base sheet A:

NBR: 85 (parts by weight
$TiO_2$: 100
$CaCO_3$: 140
petroleum resin: 15
small glass microspheres 140
(average diamter 100 μm)

These materials were blended and formed into a sheet having a thickness of 0.7 mm and a width of 1,000 mm through an extrusion process at a processing temperature of 90° C.

For producing the lower layer 2 of Examples 1, 2 and 3, the following ingredients were used:

| | Example 1 | Example 2 | Example 3 | (parts by weight) |
|---|---|---|---|---|
| NBR | 85 | 90 | 70 | |
| $TiO_2$ | 100 | 100 | 100 | |
| $CaCO_3$ | 130 | 130 | 140 | |
| petroleum resin | 10 | 10 | 5 | |
| liquid rubber | 15 | — | 5 | |
| chlorinated polyethylene | 4 | 10 | — | |
| D.O.P. | — | 5 | 10 | |
| small glass microspheres | 170 | 170 | 170 | |

These materials for the lower layer 2 were blended and formed into a sheet having a thickness of 0.7 mm and a width of 1,000 mm through an extrusion process. An adhesive layer 8 was formed by superposing a release paper coated with a pressure sensitive adhesive to a thickness of 100 μm on the lower surface of the lower layer 2.

A pressure sensitive adhesive was coated on the upper surface of the lower layer 2 and then the upper layer 1 was superposed on the lower layer 2 and the two layers 1 and 2 were bonded together. Then, toluol was coated on the surface of the upper layer 1 in a coating amount of 5 g–6 g. Glass microspheres having an average diamter of 350 μm and refractive index of 1.50 were uniformly dispersed over the undried surface of the upper layer 1. The base sheet A was then dried at 80° C. for 5 minutes.

The base sheet A was passed through an embossing device at an embossing temperature of 80° C. whereby the glass microspheres were densely embedded in the surface portion of protuberances and depressions formed on the upper layer 1. For providing a layer of releasing agent on the surface of the upper layer 1 thus having the glass microspheres embedded therein, a releasing agent comprising a synthetic resin as a main ingredient was coated on the upper layer 1. The base sheet was then dried and wound into a roll to provide a finished product.

By employing the method described in JIS K6301, restoration rate of the lower layers of Examples 1, 2 and 3 was measured. More specifically, a pressing needle of a spring type hardness tester was pressed into the inside of the lower layer 2 from the surface thereof for 10 seconds and restoration of depression formed by pressing of the pressing needle after lapse of 5 minutes was measured. A depression which was not restored at all was classified as "0%" and one which was restored to such degree that there was no trace of depression was classified as "100%". Further, hardness, elongation and tensile strength of the lower surface 2 of Examples 1, 2 and 3 were measured by employing the method described in JIS K6301. Further, for the purpose of comparison, the following ingredients were blended by means of test rolls and formed into a sheet in accordance with the example described in the above cited U.S. Pat. No. 4,282,281 which was taken up as a typical example of the prior art double layer pavement marking sheet material:

NBR Hycar 1072: 100 parts by weight
chlorinated paraffin #70: 70
chlorinated paraffin #40: 15
$TiO_2$: 130 asbestos RG-100: 120 stearic acid: 3.5 hydrated silica ("HiSyl 233"): 20 small glass microspheres: 280

Hardness, restoration rate, elongation and tensile strength of this sheet (hereinafter referred to as "comparative example") were measured in the same manner as in Examples 1, 2 and 3 of the present invention. Results of measurements of the respective properties of the lower layer 2 of Examples 1, 2 and 3 and those of the comparative example are shown below.

| | Example 1 | Example 2 | Example 3 | Comparative Example |
|---|---|---|---|---|
| hardness (°) | 50 | 60 | 50 | 70–75 |
| restoration rate (%) | 0–10 | 0–10 | 0–10 | 100 |
| elongation (%) | 48 | 85 | 42 | 350 |
| tensile strength (Kg/cm) | 3.4 | 3.8 | 4.6 | 22.7 |

We claim:

1. A double layer pavement marking sheet material comprising a base sheet made of rubber or synthetic resin in which a multiplicity of glass microspheres are embedded, said base sheet comprising:

an upper layer in which said glass microspheres are embedded in such a manner that a multiplicity thereof are partially exposed from the surface of the base sheet; and a lower layer being softer and less restorable than the upper layer and having hardness within a range of 30°–75° and restoration rate of 50% or less.

2. A pavement marking sheet material as defined in claim 1 wherein hardness of said lower layer is within a range of 45°–60°.

3. A pavement marking sheet material as defined in claim 1 wherein said hardness and restoration rate of said lower layer are achieved by adding a plastic material as an ingredient of the lower layer.

* * * * *